US009039091B1

(12) United States Patent
Liu et al.

(10) Patent No.: US 9,039,091 B1
(45) Date of Patent: May 26, 2015

(54) COMPOSITE CHAIR

(71) Applicant: KEYSHEEN INDUSTRY (SHANGHAI) CO., LTD., Shanghai (CN)

(72) Inventors: Lausan Chung-Hsin Liu, Shanghai (CN); Shopo Hsin Tsu Liu, Shanghai (CN); Fibro Tsu Kun Liu, Shanghai (CN)

(73) Assignee: KEYSHEEN INDUSTRY (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 14/308,205

(22) Filed: Jun. 18, 2014

(51) Int. Cl.
*A47C 1/12* (2006.01)
*A47C 3/00* (2006.01)

(52) U.S. Cl.
CPC ..... *A47C 3/00* (2013.01)

(58) Field of Classification Search
CPC ..... A47C 4/024; A47C 7/42; A47C 4/03
USPC ..... 297/452.18, 440.13, 440.15, 440.18, 297/440.23, 446.2, 450.1, 451.9, 452.2, 297/463.1; 403/231, 240, 246, 294, 296
See application file for complete search history.

(56) References Cited

U.S. PATENT DOCUMENTS 2,303,309 A * 11/1942 McArthur ..... 403/191
3,058,777 A * 10/1962 Froedge ..... 297/440.24
4,269,532 A * 5/1981 Sorrentino ..... 403/191
4,435,103 A * 3/1984 Becker et al. ..... 403/292
5,069,506 A * 12/1991 Wieland ..... 297/440.15
5,626,394 A * 5/1997 Perry ..... 297/448.2
5,803,645 A * 9/1998 Moser et al. ..... 403/243
5,988,755 A * 11/1999 Fastelli et al. ..... 297/440.24
7,429,084 B2 * 9/2008 Diedrich ..... 297/440.16
7,448,820 B1 * 11/2008 Faber ..... 403/240
8,104,839 B2 * 1/2012 Huang ..... 297/440.1
2011/0084536 A1 * 4/2011 Huang ..... 297/440.18
2012/0228917 A1 * 9/2012 Huang ..... 297/446.2

FOREIGN PATENT DOCUMENTS

TW 277284 6/1996

* cited by examiner

*Primary Examiner* — Laurie Cranmer
(74) *Attorney, Agent, or Firm* — Muncy, Geissler, Olds & Lowe, P.C.

(57) ABSTRACT

A composite chair includes a chair frame and a fastening assembly. The chair frame includes a front support portion, a rear support portion and two support seat tubes connecting the front support portion to the rear support portion. The rear support portion includes a holding portion and two locking holes. Each support seat tube has a first opening and a second opening faced the fastening hole. The fastening assembly includes two fastening elements inserted in the first openings, a support bar connected to the two fastening elements and two fasteners run through the locking holes and the second openings to fasten to the fastening elements. Each of the fastening elements includes a butting portion and a screw hole. Each of the fasteners includes a thread portion fastened to the screw hole and a detent block butting the holding portion. The composite chair thus formed can be assembled easily.

7 Claims, 3 Drawing Sheets

COMPOSITE CHAIR

FIELD OF THE INVENTION

The present invention relates to a chair and particularly to a composite chair that can be assembled easily without welding.

BACKGROUND OF THE INVENTION

Progress of time and increasing quality of people's life have spawned diversified designs of household articles used by people to meet various requirements. Take chairs for instance, there are many types of chairs made of metal to get the benefits of stronger strength and greater durability. To make such chairs producers generally have to prepare multiple types of components, such as front legs, rear legs, a seat cushion, a backrest and the like that are formed by stamping metal tubes or plates, then assemble these components by welding or riveting. As a result, chairs made of metal usually take more manpower and cost higher than the chairs made of other material.

For instance, Taiwan patent No. 277284 discloses an improved assembly structure for a chair leg bracket. The leg bracket includes a plurality of support bars, a plurality of bridging bars welded between the plurality of support bars and a plurality of transverse bars welded on the plurality of bridging bars. Hence it can be assembled easily by welding. However, for mass production of the leg bracket at factories, the support bars, the bridging bars and the transverse bars must be first welded in one piece, then surface treatment has to be made, and finally the backrest and seat cushion are assembled. As the leg bracket finished by welding is bulky, it takes a lot of storage space and creates a great deal of troubles in the assembly plant. Moreover, because the leg bracket cannot be disassembled, transportation or packing into containers also is more cumbersome and results in higher transportation cost.

In addition, in the conventional techniques, if a chair is assembled and fastened by nuts and bolts, the nuts often need to be welded inside a chair tube. Such a welding process also increases the cost. All this indicates that how to design a chair that can be easily assembled without welding is an issue yet to be resolved.

SUMMARY OF THE INVENTION

The primary object of the present invention is to solve the problems of conventional chairs that are assembled by welding and result in higher costs and difficult in assembly and disassembly.

To achieve the foregoing object the present invention provides a composite chair that includes a chair frame and a fastening assembly. The chair frame includes a front support portion, a rear support portion opposing the front support portion and two parallel support seat tubes to bridge the front support portion and rear support portion to form a sitting space between them. The rear support portion includes a holding portion which has two locking holes to fasten to the two support seat tubes. Each of the two support seat tubes has a first opening faced the sitting space and a second opening faced one locking hole. The fastening assembly includes two fastening elements inserted respectively in the first openings, a support bar connecting to the fastening elements and two fasteners running through the two locking holes and second openings to fasten to the fastening elements. Each fastening element includes a butting portion abutting the surface of the support seat tube and a screw hole located in the support seat tube while the fastening element is inserted in the first opening. Each of the two fasteners includes a thread portion screwing with the screw hole and a detent block abutting the holding portion.

In one embodiment each of the two fastening elements includes a latch portion extending from the butting portions towards the support bar. The support bar has two coupling portions coupling on the latch portion.

In another embodiment each of the two fastening elements includes at least one retaining stud deposed on the butting portion. Each of the two support seat tubes includes at least one confining notch corresponding to and latching the retaining stud to constrain the fastening element from turning against the support seat tube.

In yet another embodiment the rear support portion includes two rear legs connected to the holding portion and a backrest connected to the two rear legs.

In yet another embodiment the front support portion includes a bridging tube connecting with the two support seat tubes and two front legs connected to the bridging tube.

In yet another embodiment the holding portion includes two connecting portions corresponding to the two locking holes and run through the second opening to couple with the two support seat tubes.

In yet another embodiment the chair frame includes a seat slip deposed in the sitting space and coupled on the two support seat tubes.

The composite chair thus formed, compared with the conventional chairs, provides features as follows:

1. The fastening assembly includes the two fastening elements, the support bar and the two fasteners. The support bar can be coupled on the two fastening elements, and then the two fasteners can be fastened to the fastening elements to assemble the chair frame to easily finish assembly of the composite chair. Because of the fastening assembly, there is no need for welding, hence the cost of the composite chair can be reduced, and assembly and disassembly can be accomplished easily to shrink the size of the composite chair during transportation.

2. Through the retaining stud, the confining notch and the connecting portions, the chair frame can be coupled with the fastening assembly simpler and total coupling strength also increases.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
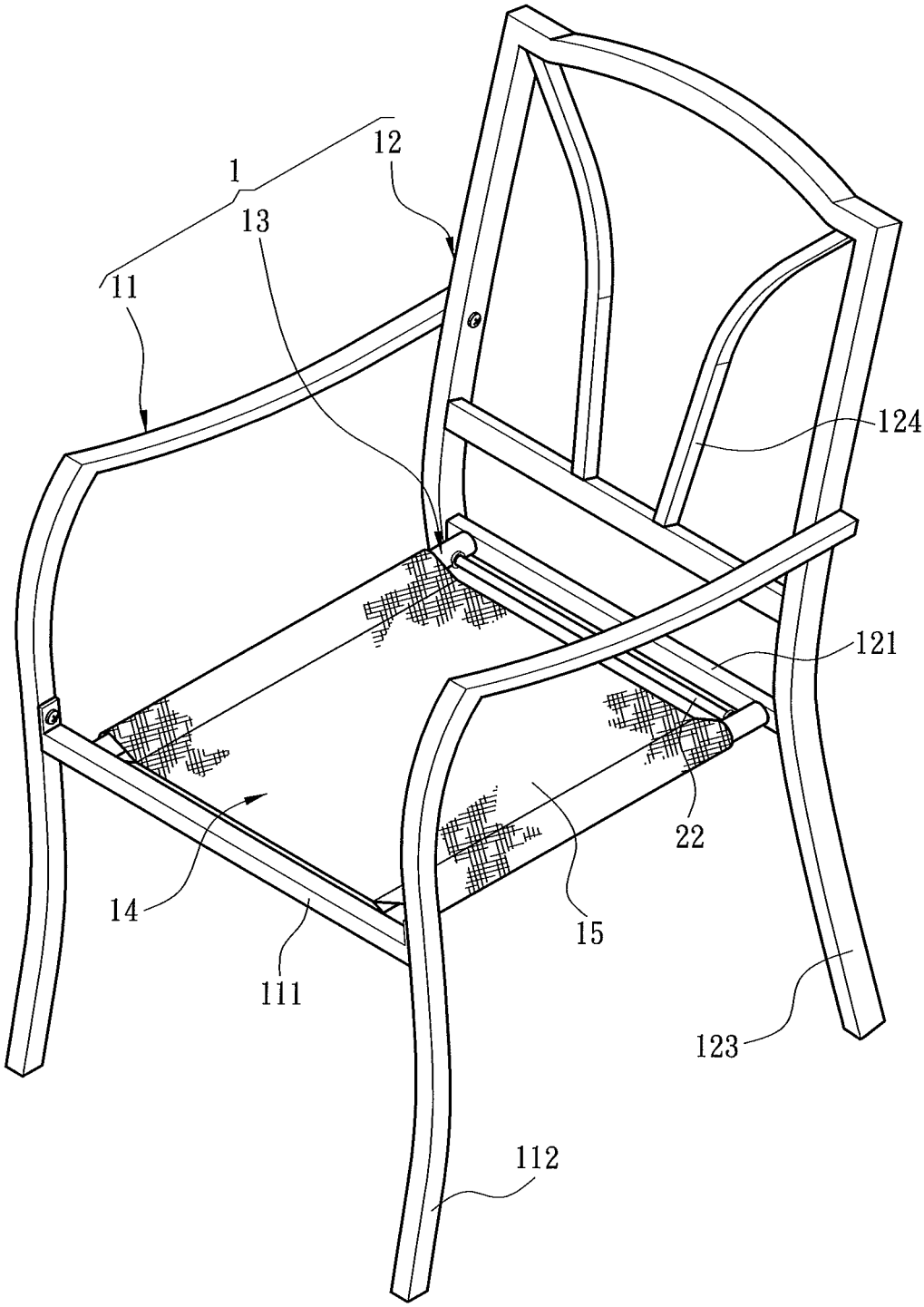
FIG. 1 is a perspective view of the composite chair of the invention.
Figure 2:
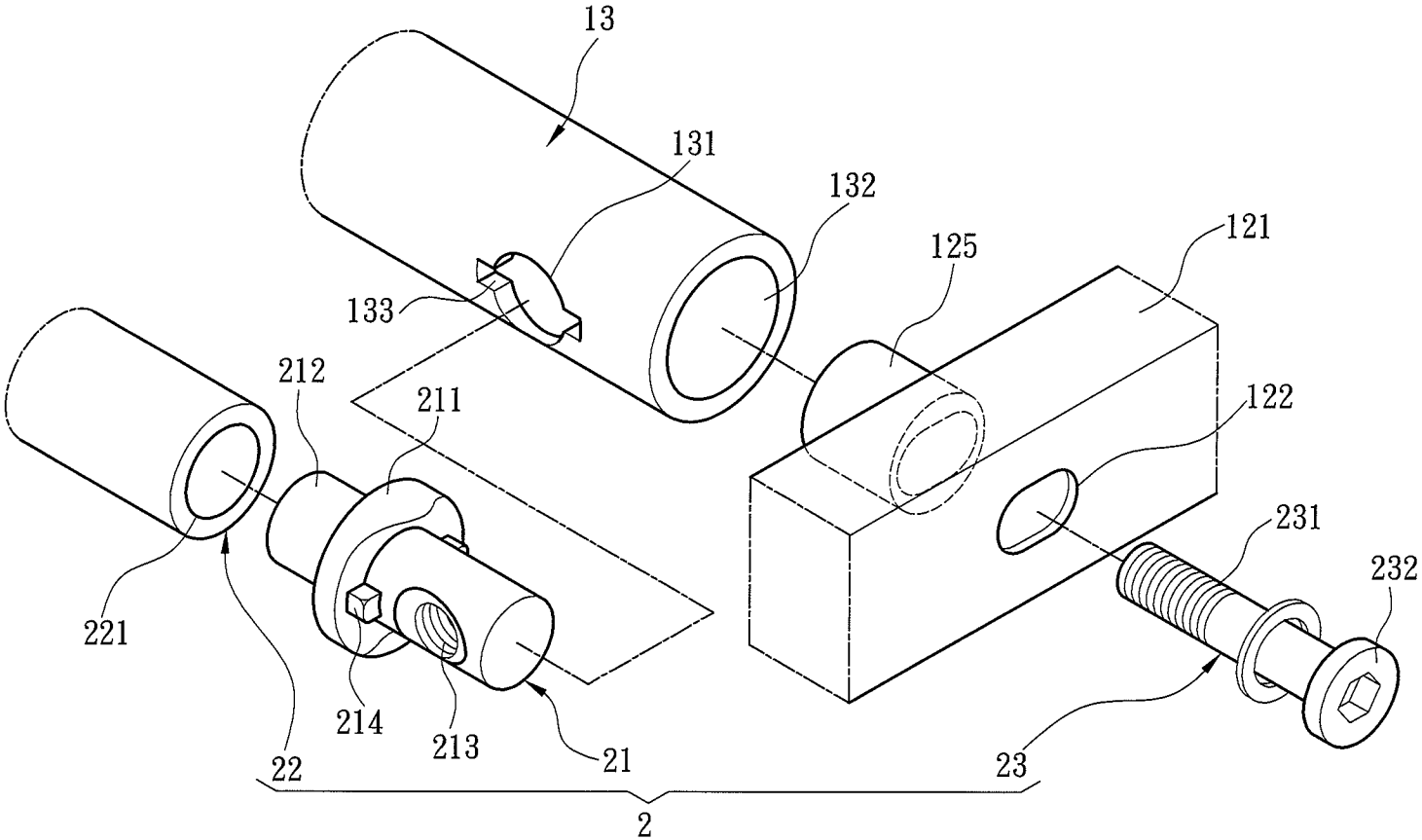
FIG. 2 is a fragmentary exploded view of the composite chair of the invention.

Please referring to FIGS. 1 and 2, the present invention aims to provide a composite chair that includes a chair frame 1 and a fastening assembly 2 fastened to the chair frame 1. The chair frame 1 includes a front support portion 11, a rear support portion 12 opposing the front support portion 11 and two parallel support seat tubes 13 between the front support portion 11 and the rear support portion 12 to bridge the front support portion 11 and the rear support portion 12. The front support portion 11 includes a bridging tube 111 connected to the support seat tubes 13 and two front legs 112 bridged by the bridging tube 111. In this embodiment the bridging tube 111 and the support seat tubes 13 are welded to form a U-shaped frame, but this is not the limitation. In other embodiments the bridging tube 111 and the support seat tubes 13 can be two separated elements that are fastened together via, but not limited to, holding elements such as a bolt, a screw, a screw shank, a pin or a clip ring. The rear support portion 12 includes a holding portion 121, two fastening holes 122 formed on the holding portion 121 to couple with the two support seat tubes 13, two rear legs 123 connected to the holding portion 121, and a backrest 124 connected to the rear legs 123. In this embodiment, the front legs 112 are connected to the backrest 124 to form a left armrest and a right armrest, but this also is not the limitation of the invention. In addition, the holding portion 121 is located between the two rear legs 123 and connected to the two rear legs 123. In other embodiments, the holding portion 121 can be two separated elements respectively located on the two rear legs 123, but this also is not the limitation of the invention. The two support seat tubes 13, the front support portion 11 and the rear support portion 12 jointly form a sitting space 14 for a user to seat. Each support seat tube 13 has a first opening 131 faced the sitting space 14 and a second opening 132 faced the locking hole 122. The chair frame 1 also has a seat slip 15 coupled on the support seat tubes 13.

Figure 3:
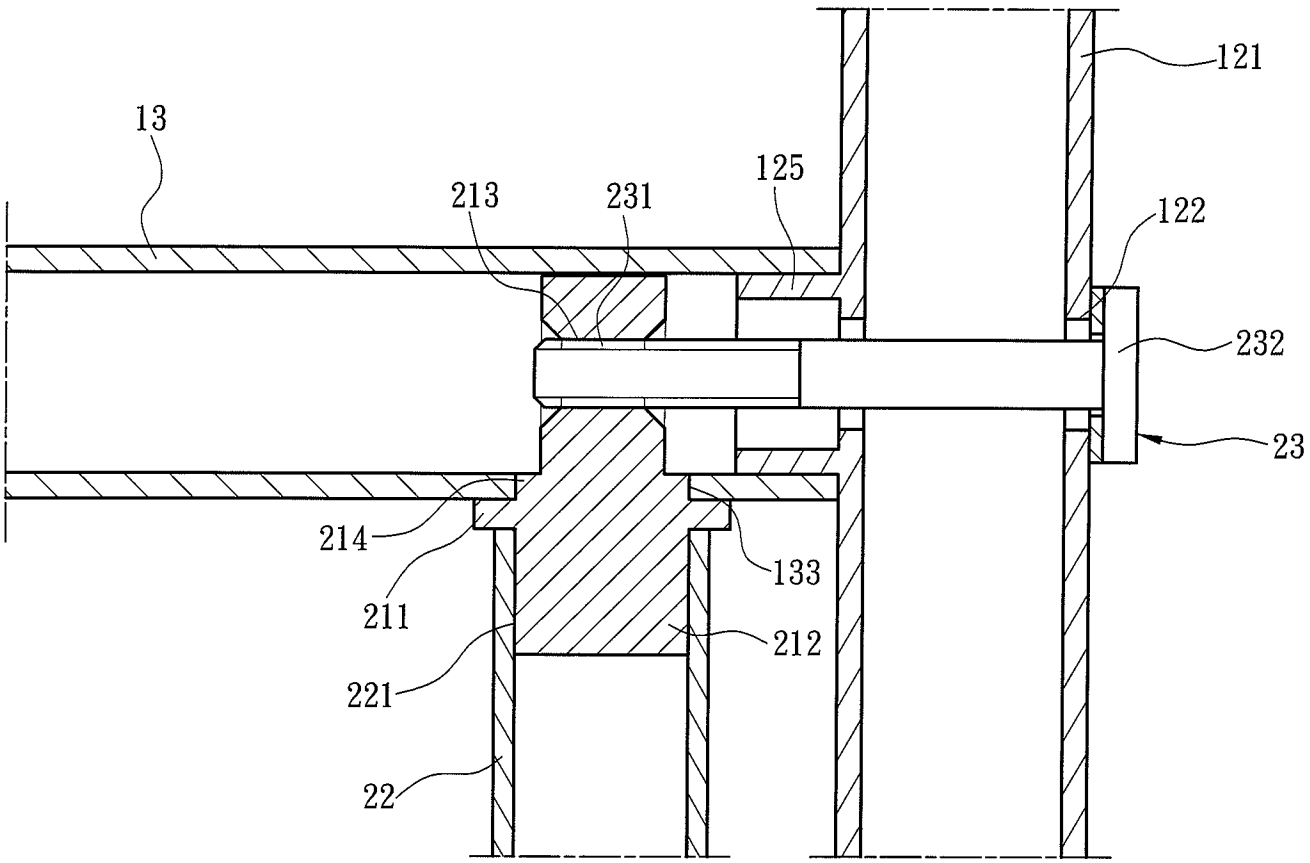
FIG. 3 is a fragmentary sectional view of the composite chair of the invention.

Please referring to FIGS. 2 and 3, the fastening assembly 2 includes two fastening elements 21 inserted respectively in the first openings 131 of the two support seat tubes 13, a support bar 22 connected to the two fastening elements 21 and two fasteners 23 run through the locking holes 122 and the second openings 132 to fasten to the two fastening elements 21. Each fastening element 21 includes a butting portion 211 abutting the surface of the support seat tube 13, a latch portion 212 extending from the butting portion 211 towards the support bar 22, and a screw hole 213 located in the support seat tube 13 while the fastening element 21 is inserted in the first opening 131. The support bar 22 has two coupling portions 221 coupling on the latch portion 212. In this embodiment the latch portion 212 is a strut and the coupling portion 221 is an aperture to hold the strut, but this is not the limitation of the invention. In other embodiments the latch portion 212 can be an aperture while the coupling portion 221 can be a strut inserted into the aperture. This also is not the limitation of the invention. Each fastener 23 includes a thread portion 231 fastened with the screw hole 213 and a detent block 232 abutting the holding portion 121 for fastening the two support seat tubes 13 to the holding portion 121. Furthermore, in this embodiment the support seat tubes 13 are round tubes, hence the butting portion 211 has an arched surface mating shape of the round tubes. In other embodiments the support seat tubes 13 can be square tubes, then the butting portion 211 has a mating flat surface, this also is not the limitation of the invention.

Also, in order to form firmer coupling and fastening of the chair frame 1 and the fastening assembly 2, each fastening element 21 includes at least one retaining stud 214 disposed on the butting portion 211, and each support seat tube 13 has at least one confining notch 133 on the surface thereof corresponding to and latched by the retaining stud 214, thereby to constrain the fastening element 21 from turning against the support seat tube 13. In addition, the holding portion 121 includes two jutting connecting portions 125 corresponding to the two locking holes 122. The connecting portions 125 can be insert in the second openings 132 and connected to the support seat tubes 13, thereby facilitate assembly of the support seat tubes 13. Through the retaining stud 214, the confining notch 133 and the connecting portion 125, total fastening strength of the chair frame 1 and fastening assembly 2 can be enhanced.

Please referring to FIGS. 2 and 3, for assembly of the chair frame 1 and the fastening assembly 2, first, couple the latch portion 221 of the support bar 22 on the coupling portion 212 of the fastening portion 21. Next, align the retaining stud 214 with the confining notch 133 and insert the fastening element 21 into the first opening 131 to position the screw hole 213 inside the support seat tube 13, and then couple the second opening 132 on the connecting portion 125 of the holding portion 121. Finally, have the fastener 23 run through the locking hole 122 and second opening 132, and screw the thread portion 231 with the screw hole 213 to make the detent block 232 tightly pressed against the holding portion 121. Thus, the chair frame 1 can be easily assembled in one piece through the fastening assembly 2.

As a conclusion, the composite chair of the invention includes a chair frame and a fastening assembly. The chair frame mainly includes a rear support portion and two support seat tubes connected to the rear support portion. The rear support portion includes a holding portion and two locking holes formed on the holding portion to couple with the two support seat tubes. The fastening assembly includes two fastening elements inserted into the two support seat tubes, a support bar connected to the two fastening elements and two fasteners run through the support seat tubes and the fastened to the fastening elements. Each fastening element mainly includes a screw hole plugged in the support seat tube. Each fastener has a thread portion run through the support seat tube and fastened to the screw hole, and a detent block abutting the holding portion for fastening the holding portion to the two support seat tubes together. Thus, the chair frame can be easily assembled to reduce welding cost and physical size. Moreover, through the retaining stud, the confining notch and the connecting portion, assembly of the chair frame and the fastening assembly can be accomplished easier and the coupling strength thereof also can be enhanced.

What is claimed is:

1. A composite chair, comprising:

a chair frame including a front support portion, a rear support portion opposing the front support portion and two parallel support seat tubes between the front support portion and the rear support portion to bridge the front support portion and the rear support portion to form a sitting space therebetween, the rear support portion including a holding portion and two locking holes formed on the holding portion to couple with the two support seat tubes, each of the two support seat tubes including a first opening faced the sitting space and a second opening faced the locking hole; and a fastening assembly including two fastening elements respectively inserted in the first openings of the two support seat tubes, a support bar connecting to the two fastening elements and two fasteners running through the two locking holes and the second openings to fasten to the two fastening elements, each of the two fastening elements including a butting portion abutting surface of the support seat tube and a screw hole located in the support seat tube while the fastening element is inserted in the first opening, each of the two fasteners including a thread portion screwing with the screw hole and a detent block abutting the holding portion for fastening the two support seat tubes to the holding portion.

2. The composite chair of claim 1, wherein the each of the two fastening elements includes a latch portion extending from the butting portion towards the support bar, the support bar including two coupling portions coupling on the latch portions.

3. The composite chair of claim 1, wherein each of the two fastening elements includes at least one retaining stud disposed on the butting portion, each of the two support seat tubes including at least one confining notch corresponding to and latching the retaining stud of the fastening element to constrain the fastening element from turning against the support seat tube.

4. The composite chair of claim 1, wherein the rear support portion includes two rear legs connected to the holding portion and a backrest connected to the two rear legs.

5. The composite chair of claim 4, wherein the front support portion includes a bridging tube connecting with the two support seat tubes and two front legs connected to the bridging tube.

6. The composite chair of claim 1, wherein the holding portion includes two connecting portions corresponding to the two locking holes and running through the second openings to couple with the two support seat tubes.

7. The composite chair of claim 1, wherein the chair frame includes a seat slip disposed in the sitting space and coupled on the two support seat tubes.

* * * * *